US007671722B1

(12) United States Patent
Macaw

(10) Patent No.: US 7,671,722 B1
(45) Date of Patent: Mar. 2, 2010

(54) PILL STORAGE SYSTEM

(76) Inventor: Linda J. Macaw, 1240 N. Lake Sybelia Dr., Naitland, FL (US) 32751

( * ) Notice: Subject to any disclaimer, the term of this patent is extended or adjusted under 35 U.S.C. 154(b) by 307 days.

(21) Appl. No.: 11/766,464

(22) Filed: Jun. 21, 2007

(51) Int. Cl.
*G08B 1/00* (2006.01)

(52) U.S. Cl. ..... 340/309.16

(58) Field of Classification Search ..... 340/309.16, 340/573.1, 691.1; 368/10, 28, 89, 243
See application file for complete search history.

(56) References Cited

U.S. PATENT DOCUMENTS

| | | | | |
|---|---|---|---|---|
| D312,981 | S | 12/1990 | Palmer | |
| 5,157,640 | A * | 10/1992 | Backner | 368/10 |
| 5,400,301 | A | 3/1995 | Rackley | |
| 5,850,937 | A | 12/1998 | Rauche | |
| 6,223,559 | B1 | 5/2001 | Coleman | |
| 6,234,343 | B1 | 5/2001 | Papp | |
| 6,301,196 | B1 | 10/2001 | Daniel | |
| 6,340,242 | B1 | 1/2002 | Sandidge | |
| 6,464,389 | B1 * | 10/2002 | Ghoorahoo | 368/278 |
| 7,196,972 | B2 * | 3/2007 | Pitocco et al. | 368/10 |
| 2005/0073911 | A1 | 4/2005 | Barnett | |

* cited by examiner

*Primary Examiner*—Phung Nguyen

(57) ABSTRACT

A pill storage system includes a housing that with a bottom wall and a peripheral wall is attached to and extends upwardly from the bottom wall. The peripheral wall has an upper edge defining an opening into an interior of the housing. A cover is removably positioned over the opening and closes the housing. At least one loop is attached to an outer surface of the bottom wall. A bracelet for being worn by a user of the housing extends through the at least one loop. The bracelet removably secures the housing to the user.

2 Claims, 3 Drawing Sheets

PILL STORAGE SYSTEM

BACKGROUND OF THE INVENTION

1. Field of the Invention

The present invention relates to pill holding devices and more particularly pertains to a new pill holding device for storing pills on the wrist of a person.

2. Description of the Prior Art

The use of pill holding devices is known in the prior art. While these devices fulfill their respective, particular objectives and requirements, the need remains for a system that can hold a plurality of pills and can be added to, modularly, as needed for the inclusion of addition pills. Further, the device should be capable of alerting the user of the system when the pills are to be taken. This should be accomplished in a manner that allows schedule variations so that the user is alerting at a selected time for each pill.

SUMMARY OF THE INVENTION

The present invention meets the needs presented above by generally comprising a housing that includes a bottom wall and a peripheral wall is attached to and extends upwardly from the bottom wall. The peripheral wall has an upper edge defining an opening into an interior of the housing. A cover is removably positioned over the opening and closes the housing. At least one loop is attached to an outer surface of the bottom wall. A bracelet for being worn by a user of the housing extends through the at least one loop. The bracelet removably secures the housing to the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
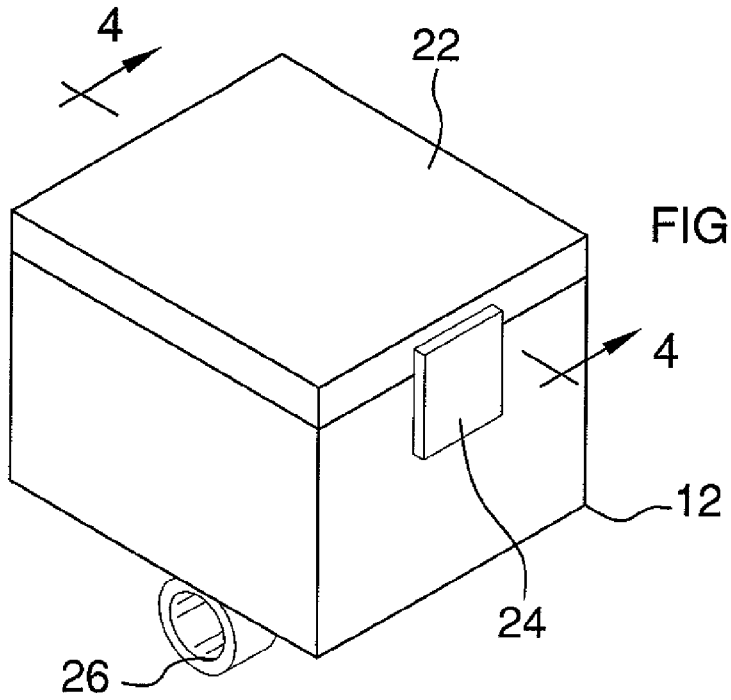
FIG. 1 is a top and front perspective view of a housing of a pill storage system according to the present invention.
Figure 2:
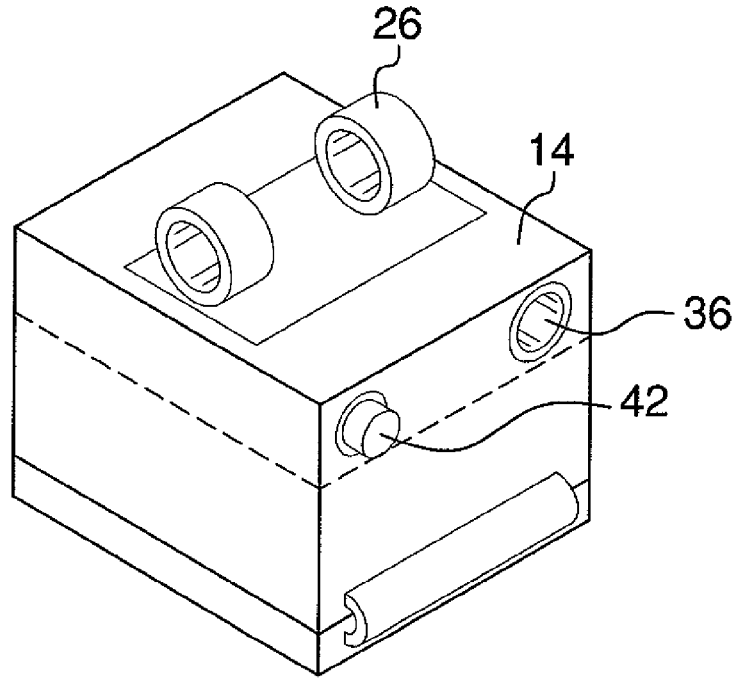
FIG. 2 is a bottom and rear perspective view of the housing of the present invention.
Figure 3:
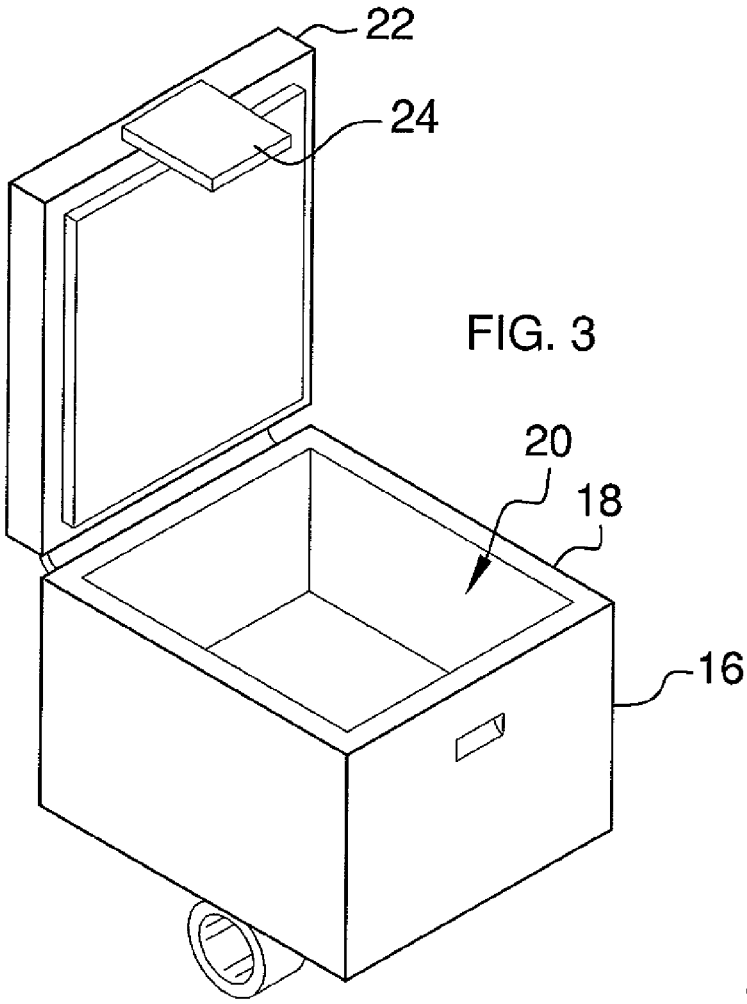
FIG. 3 is a top perspective view of the housing of the present invention.
Figure 4:
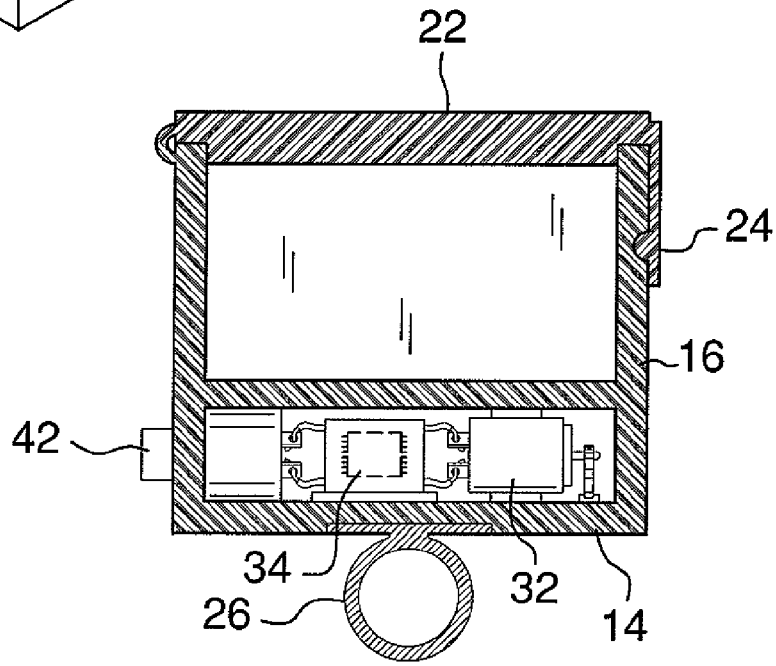
FIG. 4 is a cross-sectional view taken along line 4-4 of FIG. 1 of the present invention.
Figure 5:
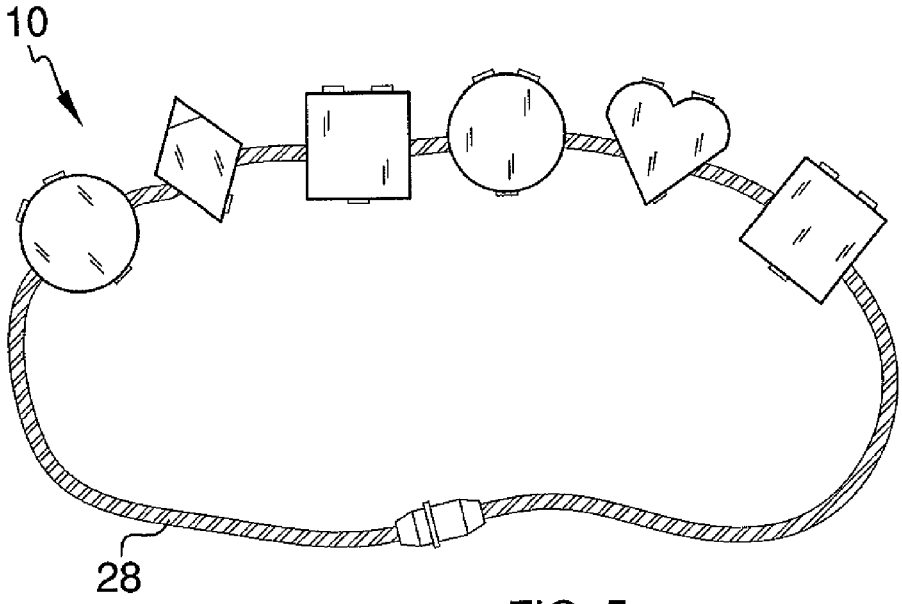
FIG. 5 is a top view of the present invention.
Figure 6:
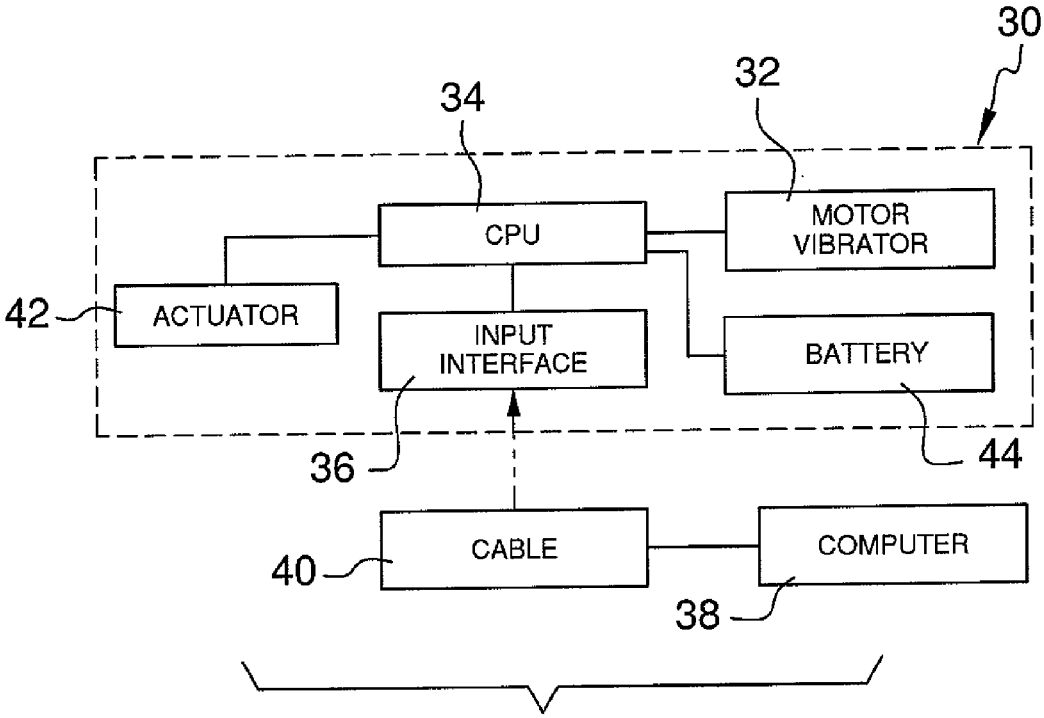
FIG. 6 is a schematic view of the present invention.

With reference now to the drawings, and in particular to FIGS. 1 through 6 thereof, a new pill holding device embodying the principles and concepts of the present invention and generally designated by the reference numeral 10 will be described. It should be understood that the term "pill" is being used generically for any type of medication which is contained in pill form, including, but not limited to, tablets, caplets and pills.

As best illustrated in FIGS. 1 through 6, the pill storage system 10 generally comprises at least one housing 12, and preferably a plurality of housings. Each of the housings 12 includes a bottom wall 14 and a peripheral wall 16 that is attached to and extends upwardly from the bottom wall 12. The peripheral wall 16 has an upper edge 18 defining an opening 20 into an interior of the housing 12. A cover 22 is removably positioned over the opening 20 and closes the housing 12. The cover 22 is pivotally coupled to the peripheral wall 16. A latch 24 attached to the cover 22 frictionally engages the peripheral wall 16 to secure the cover 22 in a closed position. At least one loop 26 is attached to an outer surface of the bottom wall 14.

A bracelet 28 for being worn by a user of the system 10 is extended through the loops 26 of the housings 12. The bracelet 28 removably secures each of the housings 12 to the user.

A plurality of signaling assemblies 30 is provided. Each of the housings 12 has one of the signaling assemblies 30 attached thereto. The signaling assemblies 30 signal the user when medication in an associated one of the housings 12 is to be taken by the user. Each of the signaling assemblies 30 includes an oscillator 32 which vibrates the associated one of the housings 12 when turned on. A processor 34 is electrically coupled to the oscillator 32 and is programmable to turn on the oscillator 32 at a selected time, or at selected time intervals. An input port 36 is electrically coupled to the processor 34. The input port 36 is selectively placed in communication with a computer 38 to allow programming of the processor 34. A conventional input cable 40 may be used to place the processor 34 in communication with a USB port of a computer 38 having a program thereon which can be used to communicate with and program the processor 34 as needed. An actuator 42 is electrically coupled to the processor 34. The processor 34 is alternately turned on or off when the actuator 42 is actuated. A power supply 44 is electrically coupled to the processor 34. The power supply 44 may be charged by the USB port of the computer 38.

In use, a user first programs each processor 34 of the housings 12 to vibrate at a selected time interval. The housings 12 are then filled with their correct medication, which may include one or more pills, associated with the selected time interval. The housings 12 are then placed on the bracelet 28 and the bracelet 28 worn by the user. The housings 12 will vibrate, at the selected time intervals, to signal the user to take the medication from the vibrating housing 12. The housings 12 may include switches mechanically coupled to the cover 22 to signal the processor 34 to turn off the oscillator 32 when then cover 22 has been opened, or the processors 32 may be programmed to only turn the oscillator 32 on for a pre-selected amount of time, such as between 10 seconds and 60 seconds.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A medication holding system comprising:

a plurality of housings, each of said housings including:

a bottom wall and a peripheral wall being attached to and extending upwardly from said bottom wall, said peripheral wall having an upper edge defining an opening into an interior of said housing;

a cover being removably positioned over said opening and closing said housing, said cover being pivotally coupled to said peripheral wall;

at least one loop being attached to an outer surface of said bottom wall;

a bracelet for being worn by a user of said system extending through said loops, said bracelet removably securing each of said housings to the user;

a plurality of signaling assemblies, each of said housings having one of said signaling assemblies attached thereto, each of said signaling assemblies signaling the user when medication in an associated one of said housings is to be taken by the user, each of said signaling assemblies including;

an oscillator;

a processor being electrically coupled to said oscillator and being programmable to turn on said oscillator at a selected time;

an input port being electrically coupled to said processor, said input port being selectively placed in communication with a computer to allow programming of said processor;

an actuator being electrically coupled to said processor, said processor being alternately turned on or off when said actuator is actuated; and a power supply being electrically coupled to said processor.

2. A medication holding system comprising:

a housing including:

a bottom wall and a peripheral wall being attached to and extending upwardly from said bottom wall, said peripheral wall having an upper edge defining an opening into an interior of said housing;

a cover being removably positioned over said opening and closing said housing, said cover being pivotally coupled to said peripheral wall;

at least one loop being attached to an outer surface of said bottom wall;

a bracelet for being worn by a user of said system extending through said at least one loop loop, said bracelet removably securing said housing to the user;

a signaling assembly being attached to said housing, said signaling assembly signaling the user when medication in said housing is to be taken by the user, said signaling assembly including;

an oscillator;

a processor being electrically coupled to said oscillator and being programmable to turn on said oscillator at a selected time;

an input port being electrically coupled to said processor, said input port being selectively placed in communication with a computer to allow programming of said processor;

an actuator being electrically coupled to said processor, said processor being alternately turned on or off when said actuator is actuated; and a power supply being electrically coupled to said processor.

* * * * *